United States Patent [19]

Stickels

[11] 4,119,444

[45] Oct. 10, 1978

[54] PACK NITRIDING PROCESS FOR LOW ALLOY STEEL

[75] Inventor: Charles A. Stickels, Ann Arbor, Mich.

[73] Assignee: Ford Motor Company, Dearborn, Mich.

[21] Appl. No.: 754,663

[22] Filed: Dec. 27, 1976

Related U.S. Application Data

[63] Continuation-in-part of Ser. No. 693,406, Jun. 7, 1976, and a continuation-in-part of Ser. No. 641,006, Dec. 15, 1975, abandoned.

[51] Int. Cl.[2] ..... C21D 1/06

[52] U.S. Cl. ..... 148/16.6; 148/27

[58] Field of Search ..... 148/14, 15.5, 16.5, 148/16.6, 19, 27; 427/252, 253

[56] References Cited

U.S. PATENT DOCUMENTS

| | | | |
|---|---|---|---|
| 1,772,866 | 8/1930 | Hirsch | 148/16.6 |
| 2,219,004 | 10/1940 | Daeves et al. | 427/253 |
| 2,219,005 | 10/1940 | Daeves et al. | 427/253 |
| 2,801,154 | 7/1957 | DePree et al. | 148/27 |
| 2,948,644 | 8/1960 | Aherns | 148/19 |
| 3,232,797 | 2/1966 | Bessen | 148/16.6 |
| 3,303,063 | 2/1967 | Pietryko | 148/15.5 |

FOREIGN PATENT DOCUMENTS

| | | | |
|---|---|---|---|
| 42-7,043 | 1967 | Japan | 148/15.5 |
| 311,588 | 1929 | United Kingdom | 148/14 |

*Primary Examiner*—Arthur J. Steiner

*Attorney, Agent, or Firm*—Joseph W. Malleck; Olin B. Johnson

[57] ABSTRACT

A method of nitriding metal parts is disclosed. A preferred mode requires burying the metal part to be treated in a body of vermiculite or other porous media containing urea or other suitable nitriding agent. Prior to burying, a controlled amount of an aqueous solution of the nitriding agent is absorbed into dry vermiculite; the water of the solution is removed by evaporation leaving a pasty substance coating or impregnating the grains of the vermiculite. The pasty substance coating each vermiculite grain physically forms a thin film on the external particle surface and on the surfaces of its internal porosity; the average film thickness is less than 0.001 inch. The vermiculite bearing the nitriding agent and buried part are heated in a closed container to a temperature at which the agent decomposes at a predetermined slow rate and releases gases bearing nitrogen. Heating is continued for about 4–8 hours at 700°–1300° F (preferably 925°–1050° F for 90% of the applications) to achieve a nitrided case on the metal part of the desired thickness, typically 0.002–0.005 inch thick.

11 Claims, No Drawings

PACK NITRIDING PROCESS FOR LOW ALLOY STEEL

RELATED APPLICATIONS

This is a continuation-in-part of U.S. patent application Ser. No. 641,006, filed Dec. 15, 1975 and now abandoned, and also a continuation-in-part of U.S. patent application Ser. No. 693,406, filed June 7, 1976 both commonly assigned to the assignee herein.

BACKGROUND OF THE INVENTION

To put a hard, thin, wear and fatigue resistance layer on steel parts which have been quenched and tempered, a common processing technique is employed called "low temperature nitriding". This is a process which requires special heat treating furnace equipment in order to carry out nitriding at a temperature in the range of 925°–1050° F. The process sequence consists essentially of: (a) roughly shaping the part to be treated, often by hot forging, (b) hardening by austenitizing, quenching and tempering to a hardness usually in the range of $R_c$ 25–35, (c) finish machining, and (d) nitriding at 925°–1050° F. Because the nitriding temperature is about the same as or lower than the tempering temperature, the hardness of the core material can be maintained in the range of $R_c$ 25–35. Such a process is used commercially for making some automotive-type gears.

Other currently used commercial nitriding methods either require the use of a molten salt bath (necessitating special control of bath composition) or use of a furnace with special equipment to contain an ammonia-bearing gaseous atmosphere. These processes are detailed in the eighth edition of Metals Handbook, Volume 2. The salt bath technique, as well as the technique with a furnace having an ammonia-bearing atmosphere, undesirably require considerable care to regulate the nitrogen potential so that results are consistent. It is also apparent that with any of the above processes, special equipment and considerable manipulation are required to obtain good results. This is not always obtainable in certain plant situations and certainly it is desirable to reduce the required skills in obtaining good results with any procedure.

Thus in plants or heat treating shops which lack the special equipment for low temperature nitriding or the special equipment required for salt bath or gas atmosphere nitriding, it would be most advantageous to have a method for pack nitriding, as convenient as pack carburizing. However, it is important to keep in mind that the science of pack carburizing is non-analogous, except as to cost and convenience, because it is carried out at temperatures of 1500° F. and above, where low alloy steels are austenitic, and is followed by quenching and tempering.

SUMMARY OF THE INVENTION

A primary object of this invention is to provide a method of nitriding metal parts unrestricted as to heating source and effectively carried out without special furnace atmosphere control.

Still another object of this invention is to provide a method of nitriding steel parts by the use of a granular packing having the grains thereof thinly coated with a nitriding agent having suitable thermal stability; the packing is installed about the part to be nitrided and heated using any conventional heating source, such as an electrical resistance heated furnace.

Specific features pursuant to the above objects comprise the use of a packing material consisting essentially of dry vermiculite or other porous media containing a predetermined quantity of a suitable nitriding agent, urea for example, spread on the surface and in the interstices of the grains as a thin coating; the packing containing the part to be treated therein is heated to a temperature at which the nitriding agent decomposes thereby slowly and controllably releasing a nitrogen-bearing gas for nitriding the steel part. The impregnated packing is usually a flowable material which is placed within a shell or tray during nitriding. After decomposition of the nitriding agent, the steel part is exposed to the nitrogen-bearing atmosphere for a controlled period of time. The ratio of the impregnated packing volume to the surface area of the steel part can be relatively low in some applications if the part is packed in an airtight, or nearly airtight container. The relation between the depth of the nitrided case and the time and temperature of treatment is similar to that for other methods of nitriding.

DETAILED DESCRIPTION

A preferred mode for carrying out the invention herein, comprises:

(a) Preparation of a granular packing medium, the medium being capable of being wetted by an aqueous solution of urea or other nitriding agent meeting the thermal stability of this invention and being capable of being dried without suffering significant degradation in its mechanical strength. Materials useful as a packing medium herein may be selected from the group consisting of vermiculite, charcoal granules, porous clay granules, porous ceramic granules, etc. Such materials should be selected because they possess all of the following characteristics: (1) are chemically inert, (2) have a high absorption capability, (3) are stable at high temperatures, (4) have a particle shape which is easily packable and possess adequate mechanical strength that is not easily degraded by temperatures typical of nitriding.

(b) Preparation of an aqueous solution of urea, or equivalent nitrogen-bearing agent. Suitable nitriding agents includes those compounds which are characterized by a relatively slow release of nitrogen-bearing gases at typical nitriding temperatures (925°–1050° F.). Most nitrogen-bearing organic and inorganic compounds, when heated into this temperature range, decompose rapidly releasing ammonia or other nitrogen-bearing gases, often leaving behind, in the case of organic compounds, a carbonaceous residue. The nitrogen-bearing gases released from these compounds can react with steel to form nitrides; however these are not suitable nitriding agents because all the nitriding gases are released in a matter of a few minutes after reaching the nitriding temperature. Penetration of nitrogen into the steel to a significant depth (0.002–0.005 inch) requires several hours for nitrogen diffusion. During this time, nascent nitrogen must be continually supplied to the surface of the metal. Thus, suitable agents for nitriding must either (1) have sufficient thermal stability at the nitriding temperature so that they decompose slowly, releasing nitrogen-bearing gases over a time period measured in hours, or (2) decompose on heating to form another compound which has the necessary thermal stability.

The concentration of the nitrogen-bearing agent is adjusted in the solution to provide predetermined amounts of the agent per unit volume of the packing medium when dehydrated. The amount of nitriding agent desired in the packing medium is primarily a function of (1) the amount of medium per unit surface area of parts to be nitrided, and (2) the desired thickness of the nitrided case. The preferred nitrogen-bearing agents are urea ($NH_2$—CO—$NH_2$), guanidine carbonate [$(NH_2)_2$ CNH]$_2$ $H_2CO_3$, dicyanodiamide [(NHC($NH_2$)NHCN)], and cyanuric acid $(HCNO)_3$. The agent must be selected on the basis of (1) its ability to slowly release a nitrogen-bearing gas capable of nitriding steel at typical nitriding temperatures, and (2) its ability to be readily and thinly dispersed on the packing medium by means of an aqueous solution thereby avoiding direct contact between the nitriding agent and the part. Thus, special cleaning operations after nitriding, to remove residues produced by thermal decomposition of the nitriding agent, are not needed.

(c) Absorption of the aqueous solution containing the agent into said packing medium; this may be carried out in trays at ambient temperature and pressure. The mixture is then dried by heating to a temperature of 100° F.-200° F. for a period of about 24-48 hours, removing excess water. The packing medium will thus be impregnated with a soft solid or pasty substance which is urea or other nitriding agent as specified above. The resulting dehydrated packing medium is unique in that it has the nitriding agent distributed physically in a thin film about each of the packing medium granules. Dispersion of the agent as a thin coating on the packing medium inhibits agglomeration of the agent if it melts on heating (as urea does), and assures a uniform, controlled distribution of the agent about parts of complex shape. Some prior art methods have employed granular urea as a direct packing medium. This is likely to be unsatisfactory because (1) far more urea is consumed than is needed to nitride the part, (2) since urea melts at about 273° F., the part would become coated with urea. Some of the thermal decomposition products, which would adhere to the part, are not water soluble, posing subsequent cleaning problems, and (3) it is not possible to nitride in a controlled manner, regulating the supply of nitriding agent to assure adequate nitriding without forming thick all-nitride surface layers.

(d) The impregnated packing medium is arranged about the part to be nitrided in a container with a loose fitting cover which will allow gas to escape, but restrict the entry of air. The packing medium must have been thoroughly dried before this step. Any water remaining will lead to oxidation of the steel and interfere with the nitriding process.

(e) The packed part is heated to a temperature (at least above 800° F.) for a period of time to decompose the impregnated nitriding agent, and thus allow a nitrogen bearing gas to be evolved for transferring nitrogen to the steel surface. A molecular nitrogen gas ($N_2$) is not desirable for nitriding. A nitriding temperature between 925°-1050° F., typical of other nitriding, processes, is satisfactory.

(f) Hold the part at the nitriding temperature for a period of time to produce a predetermined depth of nitrided case in the steel part and to obtain a predetermined degree of hardness for the selected surface zone of said part. Heating may be provided by any type of heating source, capable of producing the temperatures required. The period of time to carry out nitriding with this method should be 4 to 24 hours. With longer times the atmosphere generated by the nitriding agent may be dissipated and oxidation of specimens can occur.

For any given alloy, the depth of the hardened case increases with an increase in the time for nitriding, an increase of the permitted temperature of nitriding, and an increase of the concentration of nitrogen-bearing agent (urea, for example) with respect to the packing medium. The greatest surface hardnesses, however, are produced at lower nitriding temperatures with nitriding times of 8 hours or slightly less. It is well known that certain alloys (particularly those containing chromium, aluminum, and molybdenum) respond more favorably to nitriding than do other alloys. The heat treating variables of time, temperature and content of nitrogen-bearing agent must be determined by experimentation for any particular part and/or alloy. When urea is used, the content may be varied from 25-100 gms urea/liter of packing medium. Using a urea content of 40 gms/liter of packing medium, a nitriding temperature of 950° F., and a nitriding time of 6 hours will produce a nitrided case of about 0.005 inch thickness on most alloys.

Comparative test data was generated to corroborate the advantages of the method herein, using non-special economical apparatus to achieve results equivalent to that with specialized equipment. The following test sequence was undertaken. Test pieces of SAE 5140 steel were hardened by heat treatment to $R_c$ 38, then the surfaces were ground. Two of these pieces were placed in a 2000 cc. pyrex beaker in a manner to be buried or packed in about 1800 cc. of dry granular material therein. The granular material was two liters of vermiculite (serving as a dry packing medium) and was allowed to absorb 600 mm. of a water solution containing 50 grams of urea. Typically 1 liter of dry vermiculite will absorb about 300 mm. of water. The vermiculite was dried by placing it in a shallow tray and heated to a temperature of 120° F. for 24 hours. A thermocouple was inserted about 1½ inches down into the vermiculite to monitor temperatures. The beaker was closed with a loose fitting cover and placed in an electrically heated furnace preheated to 970° F. A period of about one hour transpired before the buried thermocouple reached the temperature of the furnace. When the thermocouple reached the furnace temperature, the container was held for an additional period of about four hours at 970° F. After nitriding, the hot parts were shaken out of the vermiculite, removed from the beaker and then air cooled.

The parts were lightly oxidized; such oxide was removed by soaking in a 50% aqueous solution of HCl. The pieces were sectioned, nickel-plated and mounted in bakelite for metallographic examination. Microhardness traverse readings were made using a Knoop indentor and 1 kilogram load. Results for one traverse are shown in Table I.

Table I

| Distance from Edge, Inches | Knoop Hardness | Approximate Equivalent in Rockwell C |
|---|---|---|
| .001 | 736 | 60 |
| .002 | 689 | 58 |
| .003 | 660 | 56 |
| .004 | 579 | 52 |
| .005 | 549 | 50 |
| .010 | 423 | 42 |
| .016 | 392 | 39 |
| .022 | 361 | 36 |

Upon comparison with the data in FIG. 6, page 153 of volume 2 of the eighth edition of "Metals Handbook", it is clear that the hardness gradient shown by Table I is typical of nitriding for this type of alloy steel at this combination of time and temperature. The surface of the nitrided piece has a very thin nitride layer of about 0.0002 inches thickness, also typical of parts nitrided by other methods.

It has been determined that various blends of packing medium containing the desired nitrogen-bearing agent can be utilized to obtain varying case depths. Furthermore, the packing medium may contain a mixture of different nitrogen-bearing agents each of which have thermal stability at nitriding temperatures and are not of a toxic nature according to this invention; but such mixture should preferably be of the compounds suggested below which include polymers of cyanic acid and cyanamide. In fact, it has been determined that thin steel parts can be effectively through-hardened by this process. Furthermore, after nitriding, the spent impregnated packing medium can be recycled to be used again in this process. To this end, the spent impregnated medium is again saturated with an aqueous solution of a suitable nitriding agent, dried, and is ready for reuse.

The thermal stability of a variety of nitrogen-bearing compounds was determined in a series of simple experiments. A measured amount of compound (2–10 grams) was placed in a 150 ml. pyrex beaker, the beaker was covered with aluminum foil and placed in a furnace at typical nitriding temperatures. After a certain time period, the beaker is removed from the furnace, and the residue is weighed. A piece of steel can be inserted into the beaker with the residue, and reheated to confirm that the residue is capable of nitriding steel. Following are examples of this kind of experiment.

EXAMPLE 1

3.5 gms. of ammonium carbonate, $(NH_4)_2CO_3H_2O$, were placed in a beaker, the beaker was covered with aluminum foil, and placed in a furnace at 975° F. After 10 minutes, all of the compound had disappeared. An ammonia smell was detected. This compound does not have the thermal stability needed for pack nitriding of steel.

EXAMPLE 2

Five grams of Hexamethylenetetramine ($C_6H_{12}N_4$) were placed in a beaker, covered, and heated at 975° F. After ten minutes, 0.27 gms of a carbonaceous residue remained. A piece of steel heated with this residue was not nitrided. Similar results have been obtained with ethylene diamine ($NH_2(CH_2)_2NH_2$) and formamide ($HCONH_2$). None of these compounds has the necessary thermal stability.

EXAMPLE 3

Ten grams of guanidine carbonate were placed in a beaker, covered, and heated at 975° F. After 30 minutes, 2.08 grams of residue remained. The residue (primarily melamine, $(NH_2CN)_3$, the trimer of cyanamide, according to "The Chemistry of Carbon Compounds", E. H. Rodd, editor, Elsevier Publ. Co., New York) is quite stable and does nitride steel. After 7 hours of heating, 1.97 grams of residue remained. If a piece of steel is placed in the container with the residue, the residue disappears more rapidly than without the steel. It is characteristic of nitriding with guanidine carbonate (or melamine) that almost no oxidation of the steel surface occurs unless there is substantial air leakage into the container.

EXAMPLE 4

Ten grams of Urea ($NH_2CONH_2$) were placed in a beaker, covered, and heated at 975° F. After 30 minutes, 0.49 grams of residue remained; after 4.25 hours, 0.35 grams remained. The residue is primarily cyanuric acid $(HCNO)_3$, the trimer of cyanic acid, and cyamelide, isomeric with cyanuric acid, according to "The Chemistry of Carbon Compounds", E. H. Rodd, editor. The residue disappears more rapidly when it is heated in the presence of steel, which it nitrides. When steel is heated in the presence of urea, or its decomposition products, a loose reddish oxide (identified as $Fe_3O_4$) forms on the steel surface; this oxide probably forms as a consequence of the breakdown of HCNO at the steel surface.

The compounds which have been found to have suitable thermal stability for this process are (1) those which form polymers of cyanic acid, $(HCNO)_n$, when heated, e.g., urea and cyanuric acid, and (2) those which form polymers of cyanamide, $(NH_2CN)_n$, when heated, e.g., guanidine carbonate and dicyanodiamide. There are many organic compounds derived from urea, guanidine, or cyanamide which behave in this manner. Besides the appropriate thermal stability, suitable nitriding agents should not be highly toxic or potentially explosive, and should be soluble in water and relatively inexpensive. These requirements are met by urea, guanidine carbonate, dicyanodiamide and cyanuric acid. Compounds such as melamine and cyamelide, which are both insoluble in water, would be suitable nitriding agents if they are dispersed on the packing medium by some means other than a water solution.

I claim:

1. A method of nitriding metal parts, comprising:

(a) preparing a granular packing medium which is thermally and mechanically stable at temperatures of at least 1100° F., has a high absorption capacity, and is substantially inert for the purposes herein, (b) preparing an aqueous solution containing a predetermined concentration of a nitrogen-bearing agent selected to be solid and thermally stable when subsequently dehydrated and heated to nitriding temperatures, said thermal stability being determined by the presence of a decomposition product capable of releasing nascent nitrogen after being at said nitriding temperature for at least 4 hours, (c) absorbing said aqueous solution into said packing medium to obtain a predetermined retention of the nitrogen-bearing agent therein, the amount of the agent retained in the packing medium being controlled by adjusting the concentration of the aqueous solution, (d) drying said packing medium to dehydrate and remove the water therein, the resulting packing medium being impregnated with a thin residue of said nitrogen-bearing agent on substantially all grains of said medium, said residue forming a thin integrated solid shell network the average thickness of which is no greater than 0.001 inch, (e) burying said steel part to be nitrided within said packing medium and heating said impregnated packing medium and part for a period of time sufficient to decompose said residue of said nitrogen-bearing agent for releasing nascent nitrogen bearing gas, and (f) continuing said heating for a period of time during which continuous contact between said nascent nitrogen gas and said part surface provides for nitrogen enrichment to the steel to a predetermined depth.

2. The method as in claim 1, in which the nitrogen-bearing agent is any water dissolved compound which, upon heating in the temperature range from 925°-1050° F., forms a polymer of cyanic acid (HCNO).

3. The method as in claim 1, in which the temperature at which said steel part is maintained for providing nitriding, is in the range of 925°-1050° F. for a period of time between 4-24 hours.

4. The method as in claim 1, in which said step (d) is carried out by heating under ambient pressure conditions at a temperature between 100°-200° F. for a period of time of 24-48 hours.

5. The method as in claim 1, in which said aqueous solution contains a concentration of a mixture of different nitrogen-bearing agents each of which have thermal stability at nitriding temperatures and are not highly toxic.

6. The method as in claim 1, in which during step (f) the medium and part is entrained in an enclosure which allows egress of generated gases without ingress of ambient gases.

7. The method as in claim 1, in which said nitrogen bearing agent are compounds which when heated form polymers of cyanic acid or cyanamide.

8. A method of nitriding a steel workpiece, comprising:

(a) coating a collection of inert granules with a thin film residue from a nitrogen-bearing agent aqueous solution, said granules being thermally stable at 1100° F. and said residue said residue forming a thin integrated solid shell network the average thickness of which is no greater than 0.001 inch and being thermally stable to exist as a solid at least up to 925° F., and (b) packing said granules about said workpiece and heating to a temperature of 800°-1050° F. for a period of time between 4-24 hours.

9. The method as in claim 1, in which the nitrogen-bearing agent is any water soluble compound which, upon heating in the temperature range from 925°-1050° F., forms a polymer of cyanamide ($NH_2CN$).

10. A method of nitriding metal parts, comprising:

(a) fully absorbing an aqueous solution of urea into a granular vermiculite packing medium to form a mixture, (b) slow drying said mixture at a temperature above 100° F. but less than 250° F. to dehydrate and remove all water, the resulting impregnated medium having the grains thereof coated with a solid pasty urea or urea derived substance, in the form of a thin integrated solid shell network the average thickness of which is no greater than 0.001 inch (c) fully burying a metal part to be nitrided within the impregnated medium and heating both to a temperature in excess of 800° F. to decompose said urea derived substance and release nitrogen bearing gases at a rate, said heating being carried out in the absence of ambient gases and for a period of time to enirch the metal part with a predetermined quantity of nitrogen, and (d) removing said part from the medium and air cooling to ambient temperature conditions.

11. The method as in claim 10, in which slow drying is carried out at 120° F. for about a 24 hour period.

* * * * *